US008587399B2

(12) United States Patent
Crutcher et al.

(10) Patent No.: US 8,587,399 B2
(45) Date of Patent: Nov. 19, 2013

(54) SPLIT-CORE CURRENT TRANSFORMER

(75) Inventors: Nathaniel Wood Crutcher, Westminster, CO (US); Gerald Anthony Hannam, Loveland, CO (US); Samuel F. E. Davenport, Longmont, CO (US)

(73) Assignee: Continental Control Systems, LLC, Boulder, CO (US)

( * ) Notice: Subject to any disclaimer, the term of this patent is extended or adjusted under 35 U.S.C. 154(b) by 0 days.

(21) Appl. No.: 13/366,887

(22) Filed: Feb. 6, 2012

(65) Prior Publication Data

US 2013/0200971 A1 Aug. 8, 2013

(51) Int. Cl.

| | |
|---|---|
| ***H01F 38/20*** | (2006.01) |
| ***H01F 27/02*** | (2006.01) |
| ***H01F 27/28*** | (2006.01) |
| ***H01F 27/24*** | (2006.01) |
| ***H01F 27/30*** | (2006.01) |

(52) U.S. Cl.

USPC ..... 336/173; 336/90; 336/184; 336/212; 336/198; 336/208

(58) Field of Classification Search

USPC ..... 336/90, 192, 198, 208, 212, 184, 92, 336/170, 173–175, 221

See application file for complete search history.

(56) References Cited

U.S. PATENT DOCUMENTS

| | | | | |
|---|---|---|---|---|
| 3,652,936 | A | | 3/1972 | Burkhart |
| 3,700,967 | A | | 10/1972 | Hoss |
| 3,701,008 | A | | 10/1972 | Kusters et al. |
| 3,764,858 | A | | 10/1973 | Burkhart |
| 4,258,348 | A | * | 3/1981 | Belfer et al. ..... 336/73 |
| 4,283,677 | A | | 8/1981 | Niwa |
| D260,635 | S | | 9/1981 | Lockwood |
| D260,876 | S | | 9/1981 | Pershyn |
| D260,877 | S | | 9/1981 | Scott et al. |
| 4,368,424 | A | * | 1/1983 | Miller ..... 324/142 |
| D274,614 | S | | 7/1984 | Fallon et al. |
| 4,471,271 | A | * | 9/1984 | Wendt ..... 315/411 |
| 4,558,613 | A | | 12/1985 | Nespor |
| 4,597,025 | A | | 6/1986 | Rutchik et al. |
| 4,623,865 | A | | 11/1986 | Kiesel et al. |
| D288,314 | S | | 2/1987 | Makinson et al. |

(Continued)

FOREIGN PATENT DOCUMENTS

| | | | |
|---|---|---|---|
| WO | WO9728546 | A1 | 8/1997 |
| WO | WO2008008446 | A3 | 1/2008 |
| WO | WO2011083030 | A1 | 7/2011 |

*Primary Examiner* — Lincoln Donovan
*Assistant Examiner* — Mangtin Lian
(74) *Attorney, Agent, or Firm* — James R. Young; Cochran Freund & Young LLC

(57) ABSTRACT

A split-core current transformer core comprises a U-core section in combination with a closing-bar core section that has extra length, width, and cross-sectional area as compared to the U-core section, shielding above and below secondary windings wound on bobbins that are mounted around leg portions of the U-core section and extending at least partially along a yoke portion of the core that joins the leg portions of the core, unitary construction and assemblage that accommodates calibration of output signals after assembly of the components in a base module and cover module that is hinged to the base module and has squeeze latches formed in a unitary manner with the cover housing such that they do not require assembly and do not protrude outwardly from adjacent surfaces in either open or closed mode, and other features that minimize magnetic reluctance and increase clearance and creepage distances.

13 Claims, 7 Drawing Sheets

(56) References Cited

U.S. PATENT DOCUMENTS

| | | | | | |
|---|---|---|---|---|---|
| 4,652,810 | A | | 3/1987 | Hayashi | |
| D290,456 | S | | 6/1987 | Burgher et al. | |
| D290,819 | S | | 7/1987 | Hart | |
| D293,431 | S | | 12/1987 | Makinson et al. | |
| 4,731,599 | A | | 3/1988 | Preissinger | |
| 4,746,891 | A | | 5/1988 | Zylstra | |
| 4,800,356 | A | * | 1/1989 | Ellis | 336/184 |
| 4,879,626 | A | | 11/1989 | Kim | |
| 5,182,536 | A | | 1/1993 | Boylan et al. | |
| 5,231,347 | A | | 7/1993 | Voisine et al. | |
| 5,233,324 | A | | 8/1993 | Beihoff et al. | |
| 5,426,360 | A | | 6/1995 | Maraio et al. | |
| 5,483,215 | A | | 1/1996 | Mies | |
| 5,892,420 | A | | 4/1999 | Larranaga et al. | |
| 6,014,072 | A | | 1/2000 | Gimeno et al. | |
| 6,060,975 | A | * | 5/2000 | Rowe | 336/198 |
| 6,064,192 | A | * | 5/2000 | Redmyer | 324/127 |
| 6,178,617 | B1 | | 1/2001 | Larranaga et al. | |
| 6,279,115 | B1 | | 8/2001 | Baumgartl et al. | |
| 6,483,290 | B1 | | 11/2002 | Hemminger et al. | |
| 6,507,261 | B1 | | 1/2003 | Haga et al. | |
| 6,756,776 | B2 | | 6/2004 | Perkinson et al. | |
| D532,747 | S | | 11/2006 | Ricci et al. | |
| D534,120 | S | | 12/2006 | Ricci et al. | |
| D550,618 | S | | 9/2007 | Ricci et al. | |
| D550,619 | S | | 9/2007 | Ricci et al. | |
| 7,305,310 | B2 | | 12/2007 | Slota et al. | |
| 7,598,724 | B2 | | 10/2009 | Howell et al. | |
| 7,612,552 | B2 | | 11/2009 | Dent | |
| D610,087 | S | | 2/2010 | Johnson | |
| D610,541 | S | | 2/2010 | Mueller et al. | |
| 7,660,682 | B2 | | 2/2010 | Slota et al. | |
| 7,663,459 | B2 | | 2/2010 | Horstmann | |
| D613,686 | S | | 4/2010 | Mueller et al. | |
| 7,788,055 | B2 | | 8/2010 | Walker Colsch et al. | |
| 7,969,271 | B2 | | 6/2011 | Lai et al. | |
| 2007/0007942 | A1 | | 1/2007 | King et al. | |
| 2007/0007945 | A1 | | 1/2007 | King et al. | |
| 2009/0115403 | A1 | * | 5/2009 | Bernklau | 324/127 |
| 2011/0060544 | A1 | | 3/2011 | Wu et al. | |

* cited by examiner

SPLIT-CORE CURRENT TRANSFORMER

BACKGROUND OF THE INVENTION

1. Field of the Invention

This invention is in the field of current transformers and, more particularly, spit core current transformers.

2. State of the Prior Art

Current transformers are common devices used for measuring AC current flow in electric wires or bus bars, typically, but not exclusively, in higher power installations and equipment. High power as used in this description is not intended to be limiting, but generally refers to electric power with voltages above twenty volts, as opposed to low voltage electronic circuits that operate with less than twenty volts. Essentially, a current transformer outputs a small current that is proportional to a larger current flowing in a high power electric wire or bus bar, and the use of a burden resistor on the output can provide a low voltage signal that is proportional to the current flowing in the high power electric wire or bus bar. Such small current or low voltage output signals from the current transformer can be used in a variety of instrumentation and control applications, including, for example, measuring and/or metering the amount of electric current that is generated or flowing to a load, or measuring and/or metering the amount of power that is used by a load.

A typical current transformer comprises a magnetic core, a primary winding (which may be the high power wire or bus bar), and a secondary coil wound around one or more sectors or sections of the magnetic core. Solid toroidal magnetic cores generally provide the best electrical performance for current transformers, i.e., outputting small current or voltage signals in direct proportion to, and in phase with, the current flowing in the high power primary wire or bus bar with minimal errors, and other solid (not split) core configurations, for example, square or rectangular loops are also quite good. For simplicity and convenience, the term "solid core" or adjective "solid-core" in this description includes any such toroidal, oval, square, rectangular, or other shaped solid (not split) magnetic core. However, to install a current transformer with a solid core onto a high power wire or bus bar, the high power or bus bar has to be inserted through the center hole or aperture of the solid core, which requires disconnecting the high power wire or bus bar from its high power circuit and inserting it through the solid core, and then reconnecting the high power wire or bus bar to the high power circuit.

Current transformers equipped with split magnetic cores, often called "split-core" current transformers, alleviate this inconvenience by enabling the core to be opened or disassembled for installation around a high power wire or bus bar and then closed or reassembled for operation without having to disconnect the high power wire or bus bar from its circuit. A typical split magnetic core may comprise two semicircular halves of a toroidal magnetic core, two C-shaped halves or other portions of a square or rectangular magnetic core, two U-shaped halves or other portions of an oval magnetic core, a U-shape magnetic core section with a closing-bar core section extending from one leg of the U-shape section to the other leg, and other core section configurations that can be opened or disassembled. However, a magnetic core that is split, so that it can be opened or disassembled, has unavoidable air gaps in the magnetic core, thus increasing the magnetic reluctance, which in turn decreases the permeability and causes higher excitation current, all of which increases the secondary coil output errors, particularly the phase angle error between the phase of the current in the high power wire or bus and the phase of the output current or voltage from the secondary winding. Consequently, while split-core current transformers are generally more convenient and easier to use than solid-core current transformers for many installations and circumstances, the electrical performance of split-core current transformers is not as good as comparable sized and shaped solid-core current transformers, assuming all other factors are constant, and typical split-core current transformers also draw more magnetizing current than solid-core transformers made with the same core material and of the same size. Also, while split-core current transformers alleviate the need to disconnect the high power wire or bus bar for installation, as explained above, they need bracketry and mechanisms to clamp or hold the spit-core components together upon installation on a high power wire or bus bar, which is more complicated than solid-core current transformers and can be somewhat cumbersome to use.

The foregoing examples of the related art and limitations related therewith are intended to be illustrative and not exclusive. Other limitations of the related art will become apparent to those of skill in the art upon a reading of the specification and a study of the drawings.

BRIEF DESCRIPTION OF THE DRAWINGS

The accompanying drawings, which are incorporated herein and form a part of the specification, illustrate some, but not the only or exclusive, example embodiments and/or features. It is intended that the embodiments and figures disclosed herein are to be considered illustrative rather than limiting. In the drawings.

DETAILED DESCRIPTION

Figure 1:
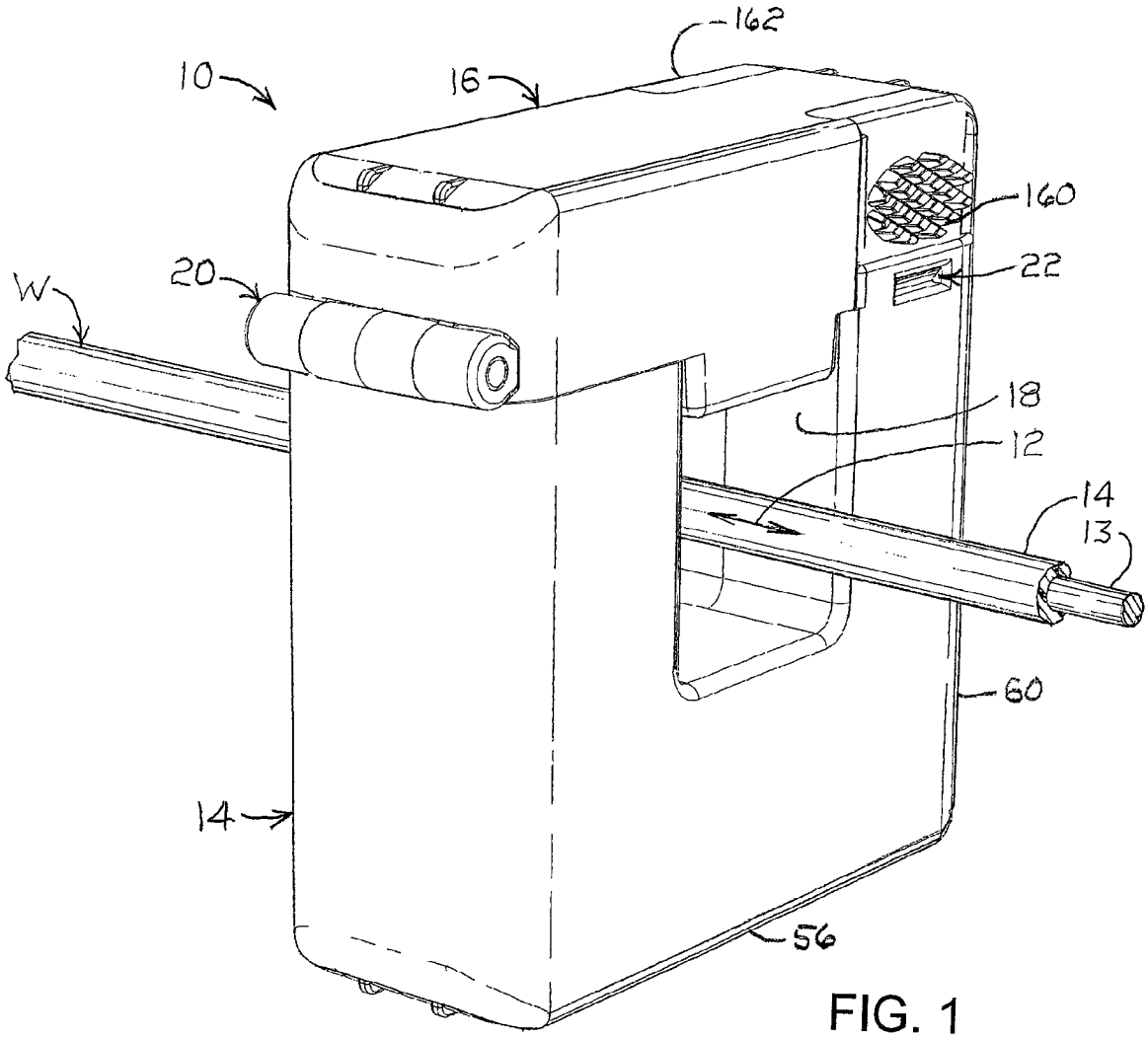
FIG. 1 is perspective view of an example split-core current transformer that embodies features of this invention.
Figure 3:
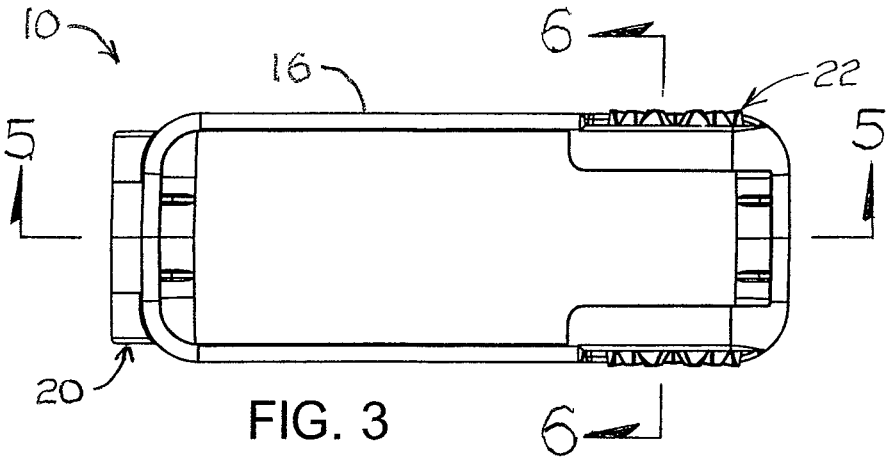
FIG. 3 is a top plan view of the example split-core current transformer in FIG. 1.

An example current transformer apparatus 10 is illustrated diagrammatically in FIG. 1 surrounding a high power conductor W in a typical position for detecting and measuring the magnitude of AC current (indicated schematically by the arrow 12) flowing in a conductor W. In this example, the conductor W is shown, for example, as a typical electrically conductive wire strand or cable 13 surrounded by electrical insulation 15, but the conductor W itself is not a part of this invention. It is shown to illustrate a typical application of a current transformer, such as the current transformer 10, for detecting and measuring AC current 12 flowing in a conductor W, which could also be a bus bar (not shown), and other conductors of AC current. Therefore, the conductor W in FIG. 1 is representative of any conductor, including a wire, cable, bus bar, or any other electrical conductor, that carries an AC current to be measured by the current transformer as described herein. Also, the conductor W is sometimes referenced herein as a primary conductor or as a high power conductor, which is for convenience in describing typical usage of the current transformer, but is not intended to be limiting or to connote any particular level or range of electric current, voltage, or power capacity or range of the conductor W or of the current measuring capabilities of the example current transformer 10. Persons skilled in the art will readily understand the use and meaning of this terminology, for example, as denoting the primary conductor that carries the AC current to be measured by the current transformer.

Figure 2:
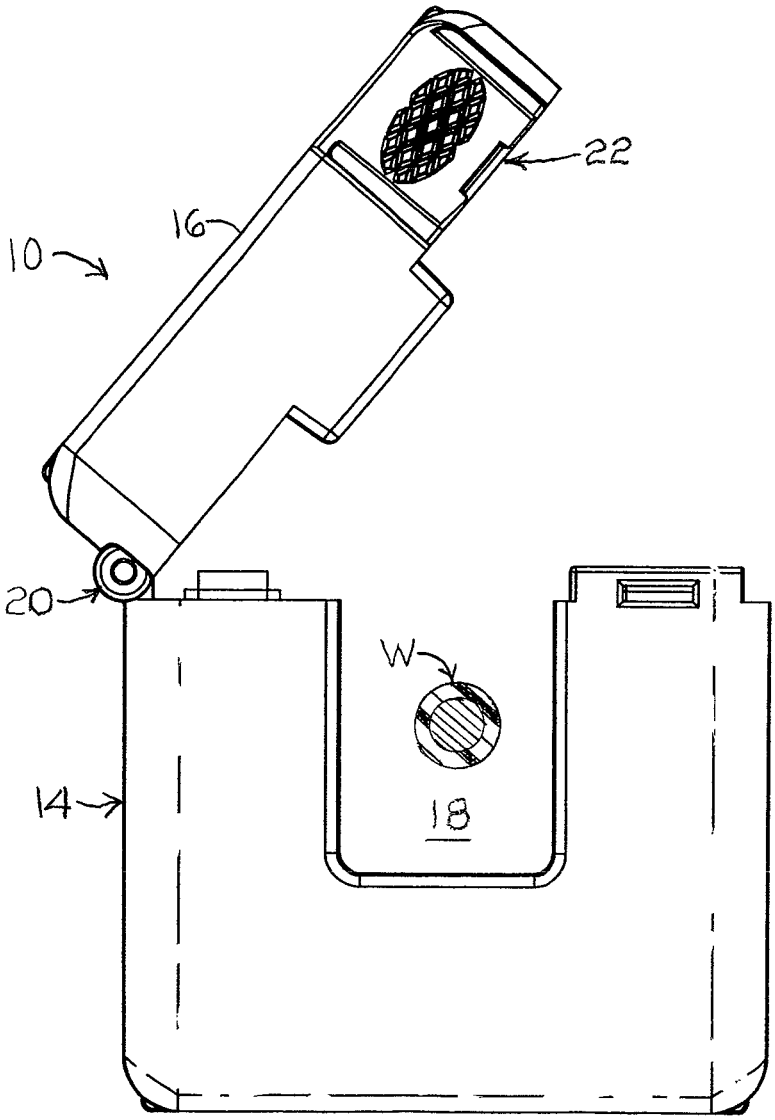
FIG. 2 is a front elevation view of the example split-core current transformer in FIG. 1, shown with the top section opened.

The example current transformer 10 shown in FIG. 1-9 is a split-core type current transformer with part of a magnetic core (described later) positioned in a base module 14 and another part of the magnetic core positioned in a cover module 16. When the cover module 16 is opened from the base module 14, as illustrated in FIG. 2, the current transformer 10 can be positioned around the primary conductor W, so that, when the cover module 16 is closed again (FIG. 1), the primary conductor W is positioned in the aperture 18 of the current transformer 10 surrounded by the base module 14 and the cover 16 as well as by the magnetic core 30 (described later), which is positioned in the base module 14 and cover 16. The cover 16 can be mounted on, or fastened to, the base module 14 in any convenient manner, although the example current transformer 10 includes some advantageous features that will be described in more detail below. Suffice it to say at this point that the cover 16 in the FIG. 1 example current transformer 10 is illustrated with a hinge attachment 20 to the base module 14 at one end of the cover module 16 and includes a convenient latch mechanism 22, which will be described in more detail below.

Figure 6:
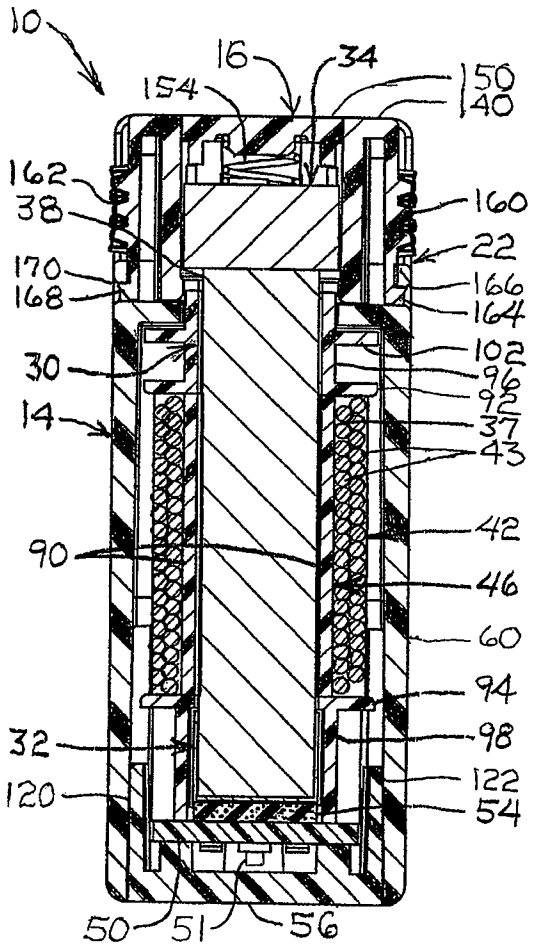
FIG. 6 is a cross-sectional view of the example split-core current transformer taken along section line 6-6 in FIG. 3.
Figure 5:
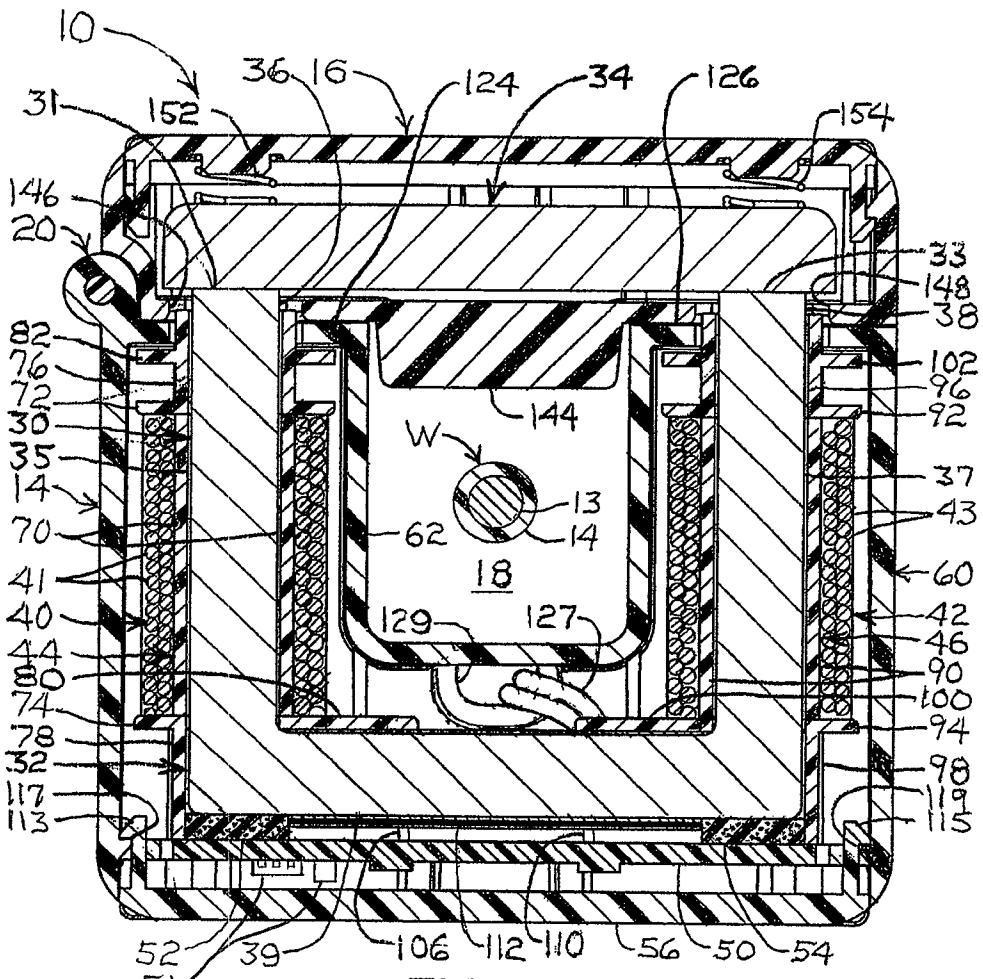
FIG. 5 is a cross-sectional view of the example split-core current transformer taken along section line 5-5 in FIG. 3.
Figure 7:
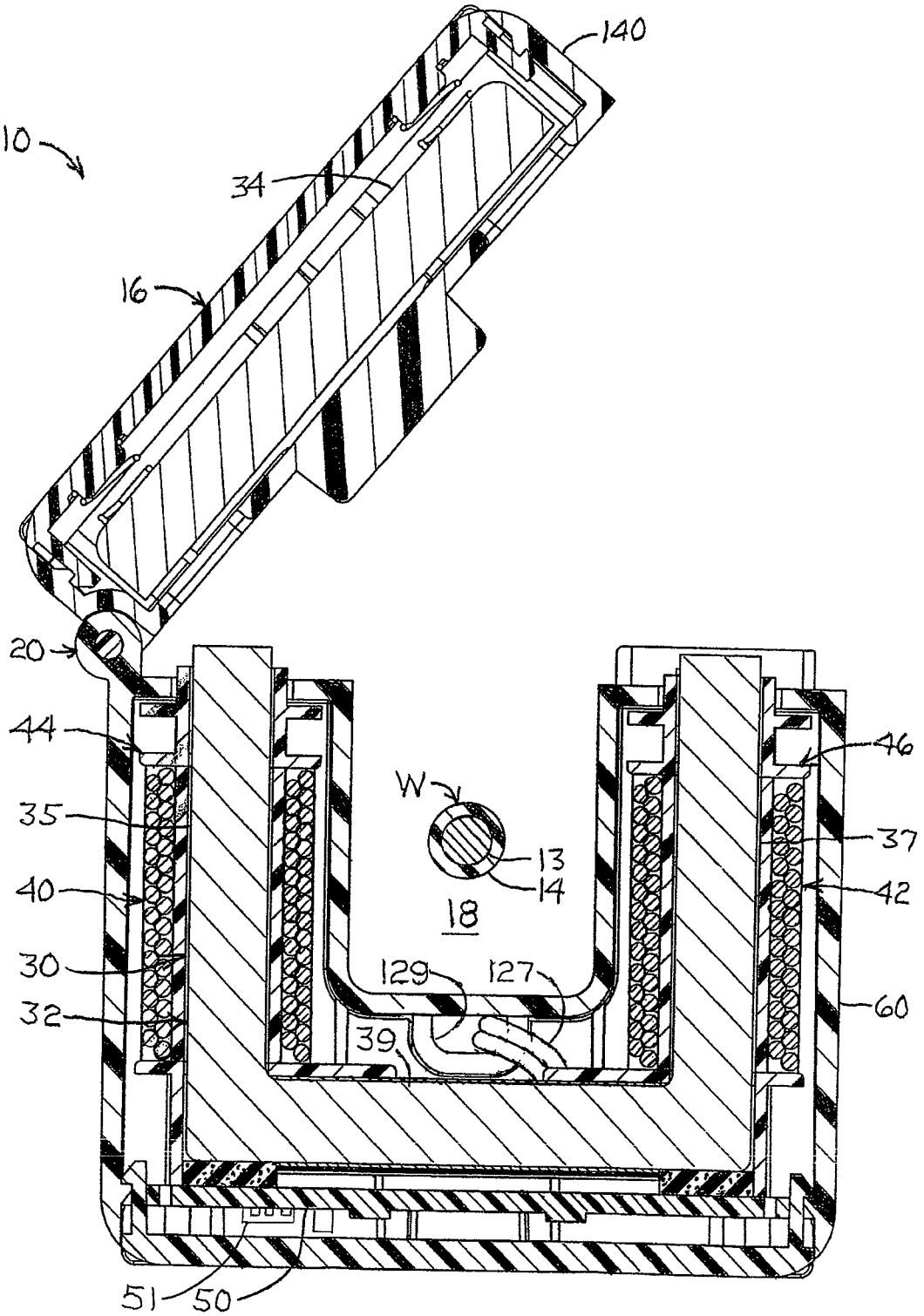
FIG. 7 is a cross-sectional view similar to FIG. 5, but with the top section opened.
Figure 8:
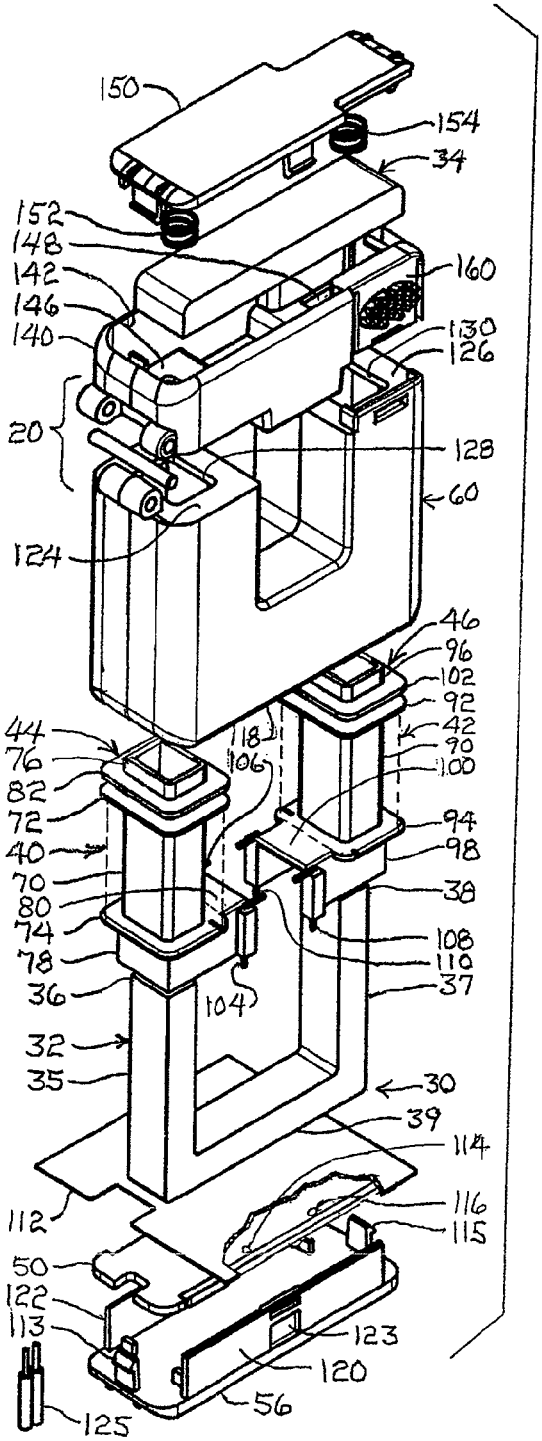
FIG. 8 is a perspective, exploded view of the components of the example split-core current transformer in FIG. 1.
Figure 9:
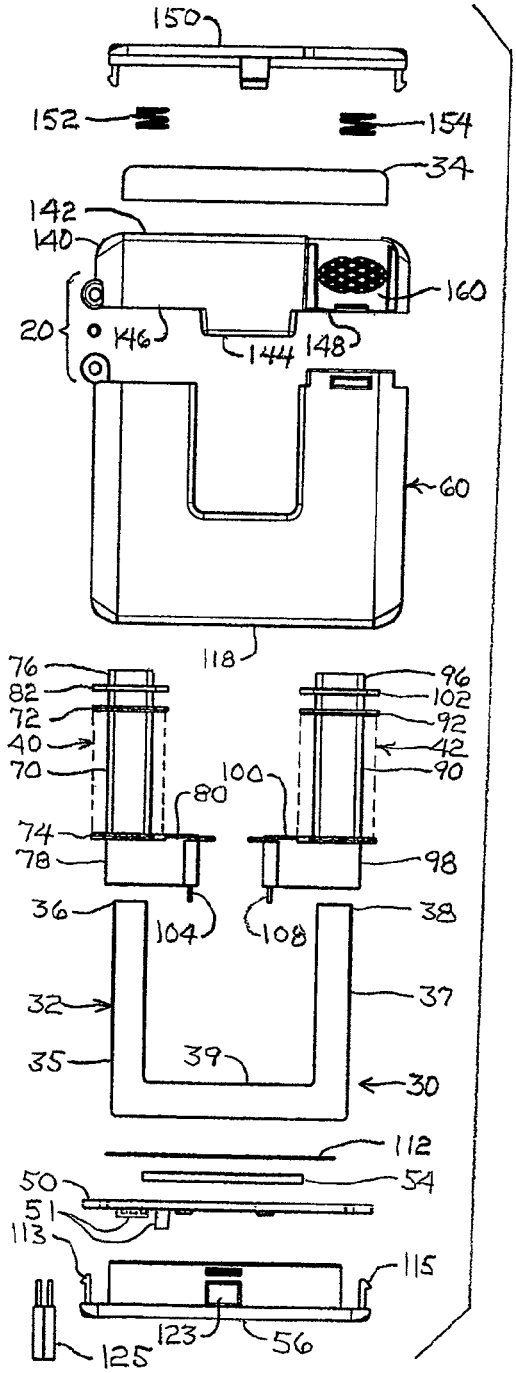
FIG. 9 is an elevation, exploded view of the components of the example split-core current transformer in FIG. 1.

Referring now primarily to FIGS. 5, 6, and 7, with secondary reference to FIGS. 8 and 9, the magnetic core 30 is comprised of a basically U-shaped base core section 32 (sometimes called "U-core") mounted in the base module 14 and a bar-shaped closing core section 34 (sometimes called "closing-bar core section") mounted in the cover module 16. When the cover module 16 is closed, as shown in FIGS. 5 and 6, the closing-bar core section 34, contacts and spans the upper ends 36, 38 of the U-core section 32, thereby forming a split-core, rectangular magnetic core 30. When the cover module 16 is opened, as illustrated in FIG. 7, the closing-bar core section 34 is moved away from the upper ends 36, 38 of the legs 35, 37 of the U-core section 32 to accommodate placement of the current transformer 10 around, or removal from, the conductor W.

Secondary windings 40, 42 are mounted on bobbins 44, 46, which are positioned around the respective legs 35, 37 of the U-shaped base core section 32. The secondary windings 40, 42 typically comprise insulated, electrically conductive wires 41, 43 wound on the respective bobbins 44, 46. The windings 40, 42 can be wired in series to function as a single secondary winding or in parallel. The number of turns of the wires 41, 43 on the spools 44, 46 depends on the design and can be varied or adjusted to optimize performance based on a number of criteria, including, for example core dimensions, desired voltage output, burden resistance, sensitivity to external load, phase angle error, ease of capacitive phase angle compensation, power dissipation, peak core flux, winding time, the cost of winding the wire, and other factors that are well-known to persons skilled in the art.

A printed circuit board (PCB) 50 is mounted in the bottom portion of the base module 14 under the yoke portion 39 of the U-core section 32. The printed circuit board 50 comprises electronic components 51 for conditioning and processing the output of the secondary windings 40, 42, which is induced by the magnetic field in the core 30, into current measurement signals, including, for example, the burden resistor, adjustment components, and protection components. Small catches or other retainer structures (not seen in FIGS. 6 and 7) can be provided on the inside of the housing 60 to hold the printed circuit board in place during calibration before the bottom panel 56 is installed. One or more shock absorbing foam pads, e.g., pads 52, 54, positioned between the printed circuit board 50 and the yoke portion 39 of the U-core section 32 provides several functions, including: (i) cushioning for protection of the ferrite U-core section 32; (ii) additional support and protection for the printed circuit board 50 and its components 51 in case the current transformer is dropped or otherwise encounters external shock or rough conditions; and (iii) pressing the U-core section 32 upward as far as it can travel in the presence of various tolerances in the body 32, bobbins 44, 46, printed circuit board 50, and closing-bar core section 34, which helps to ensure flat, consistent contact between the U-core section 32 and the closing-bar core section 34. The body 60 has an open bottom to provide easy access to the printed circuit board 50 for making any needed circuit adjustments, e.g., of resistors, capacitors, or other components, for calibration and adjustment of the current measurement output signals from the printed circuit board 50 for accuracy and phase angle. A bottom panel 56 is provided to close the open bottom after such calibration or verification testing. Such calibration can be done by comparing the signal output amplitude and phase angle to known current flows in a primary conductor W after the current transformer 10 is assembled, but before the bottom panel 56 is installed in place to close the housing 60. The panel 56 has no mechanical, electrical, or magnetic effect on any aspect of the current transformer, so installing it after calibration will not affect the calibration This feature is a significant improvement over other state-of-the-art current transformers that are designed and structured in ways that must be calibrated in a partly disassembled state to have access to components that can be adjusted and where the final assembly has the potential to affect the calibration. Consequently, other state-of-the-art current transformers, which have to be calibrated before complete assembly in order to have access to adjustment components, have to be verification tested again after assembly to ensure that the assembly process did not degrade the performance or accuracy of the device. If the verification test shows that the calibration was adversely affected by the remainder of the assembly process, then such other state-of-the-art current transformers have to be disassembled and calibrated again. Such repeat verification testing is a costly manufacturing step that can be eliminated with the example current transformer 10 structure described herein, but, even if verification testing to ensure that installation of the panel 56 has no effect on the calibration, the panel 56 can be installed while the current transformer 10 is still on a calibration fixture (not shown), which allows for an immediate verification with minimal handling.

The core 30, including the U-core section 32 and the closing-bar core section 34, can be made of any typical magnetic material, including, but not limited to, iron, grain oriented silicon steel, nickel alloys, or ferromagnetic ceramic material (e.g., $Fe_3O_4$ or $BaFe_{12}O_{19}$), which is commonly called ferrite. The combination U-core section 32 and closing bar 34 in the example current transformer 10 allows maximum space for vertical secondary windings 40, 42 on both of the legs 35, 37 of the U-core section 32 to minimize magnetic leakage, susceptibility to external magnetic fields, and magnetic saturation without resorting to use of secondary windings on the closing-bar core section 34 and yoke portion 39 of the core 30, which would increase manufacturing and assembly complexity and require the overall size of the base module 14 and cover module 16 to be larger, wider, and more bulky for a given core 30 size. These features also decrease sensitivity of the current measurement signal output to the location of the primary conductor W in the aperture 18 in relation to the core 30.

The interfaces 31, 33 of the U-core section 32 and closing-bar core section 34 are air gaps that increase the magnetic reluctance, decrease the permeability, and increase the leakage inductance (i.e., more of the magnetic flux flows through the air around the core 30 due to the higher reluctance of the path through the core), so the current transformer 10 requires a higher magnetizing (exciting) current than would a continuous core made of the same material and of comparable size and weight. Such higher magnetizing current requirement results in a larger phase angle error and lower accuracy than would occur in a solid core made of the same material and of comparable size and weight, but the advantage of being able to open the split core 30 for inserting a primary conductor W outweigh those disadvantages for many applications. Moreover, some of these disadvantages can be mitigated. For example, the core interfaces of the split core, such as these interfaces 31, 33 in the example current transformer 10, are typically shaped or machined (e.g., flat) to minimize the air gap and enhance magnetic coupling across the interfaces 31, 33 and reduce leakage inductance. Even so, inevitable slight misalignments and manufacturing variations, tolerances, and other imperfections can cause increased magnetic reluctance and leakage at the interfaces 31, 33. To further address and further mitigate this problem, the closing-bar core section 34 in the example current transformer 10 is over-sized to be longer than the distance between the respective outer edges of the tops 36, 38 of the U-core legs 35, 37, as best seen in FIG. 5, and to be wider than the tops 36, 38 of U-core legs 35, 37, as best seen in FIG. 6. Such over-sizing allows for tolerances and mitigates misalignments so that perfect alignment is not needed, and maximizes magnetic coupling and flux between the closing-bar core section 34 and the U-core section 32, thereby minimizes magnetic reluctance. The larger cross-sectional area of the closing-bar core section 34 also serves to reduce susceptibility to magnetic saturation, which is a concern because of the lack of a secondary winding on the closing-bar core section 34. Therefore, this oversizing of the closing-bar core section minimizes the exciting current draw for the split-core configuration of the example current transformer 10 and increases accuracy of the current measurement output. To obtain these advantages, the oversizing of the closing-bar core section 34 in relation to the U-core section 32 is in the following ranges: (i) The length of the closing-bar core section 34 is in a range of 5 to 20 percent (optimally 8 to 12 percent) longer than the distance between the respective outer edges of the U-core legs 35, 37 as best seen in FIG. 5; (ii) The horizontal width of the closing-bar core section 34 is in a range of 15 to 43 percent (optimally 25 to 35 percent) wider than the thickness of a U-core leg 35 or 37 as best seen in FIG. 6; and (iii) the cross-sectional area of the closing-bar core section 34 as illustrated in FIG. 6 is in a range of 10 to 45 percent (optimally 25 to 35 percent) larger than the cross-sectional area of a U-core leg 35 or 37. Such oversizing of the closing-bar core section also enhances immunity of the current transformer 10 to external magnetic fields and helps to minimize sensitivity of the current transformer 10 measurement accuracy and output to the position of the primary conductor W in the aperture 18.

Current transformers are sometimes used on bare (uninsulated) bus bar primary conductors W. Therefore, they have to be constructed in a manner that isolates a user from the voltage in a bus bar primary conductor W positioned in the aperture 18, including any high voltage spikes that might occur in a bus bar or other primary conductor W in the aperture. As can be seen in FIG. 5, the secondary windings 40, 42 would not be very far removed from a bare bus bar primary conductor W that was positioned against the interior wall 62 of the housing 60 of the base module 14, and the core 30 is also electrically conductive. Therefore, the housing 60 and other components have to be constructed in a manner that insulates a user touching or holding the current transformer 10 from a high voltage spike in the primary conductor W, yet many applications for current transformers are in small, confined spaces where large size and bulk for a current transformer would not be usable or practical. Therefore, a current transformer design, like the example current transformer 10, which has a number of design features that, together, make it both compact and still meet safety standards, e.g., ANSI C57.13, IEC 60044, IEC 61010-1 et seq., is very advantageous over other more conventional current transformer designs. In many conventional small, split-core current transformers, their cores are close enough to gaps in their housings that they do not meet such safety spacing requirements, so there is a risk that the conductive core will become energized in the event of a high voltage surge in the primary conductor W. Therefore, to meet the safety requirements for clearance (i.e., the distance a spark must travel through air from one component to another) and creepage distance (i.e., the path distance a current would have to travel along an insulated surface from one conductive material to another), the magnetic core material must be sufficiently insulated and spaced from the bobbin secondary windings 40, 42 and any circuitry leading to the lead wires 125. It is difficult to use tape to improve the creepage distances in this application, because the tape adhesive is not considered to be a dependable insulator material, and it is difficult to configure the tape in a manner that the tape itself, instead of the tape adhesive, is providing the insulation effect. Also, regular magnet wire insulation does not meet such safety requirements, because it is thin and easily nicked. Triple Teflon™ insulated wire does meet such safety requirements, but it is bulky and expensive.

In the example current transformer 10, the bobbins 44, 46 are shaped to provide additional insulative shrouding for the core 30 to increase clearance and creepage distances. Referring first to the bobbin 44 in FIGS. 5 and 6, the bobbin 44 includes a sleeve section 70 made of electrically insulative material, around which the secondary winding 40 is wound, and a top flange 72 and bottom flange 74 between which the secondary winding 40 is wound. The sleeve section 70 receives and surrounds one leg 35 of the U-core section 32 with electrically insulative material to insulate the U-core 32 from the secondary winding 40. Also, the sleeve 70 has a top extension 76 made of electrically insulating material that extends above the top flange 72 all the way to, or nearly to, the upper end 36 of the U-core leg 35 and a bottom shroud 78 made of electrically insulating material that extends below the bottom flange 74 all the way to, or nearly to, the bottom of the U-core leg 35. The bottom shroud 78 also has a channel portion 80 that extends laterally along the top and sides of the yoke portion 39 of the U-core 32. The top extension 76 also has an auxiliary flange 82 extending outwardly from the top extension 76 a distance above the top flange 72. The top flange 72, top extension 76, and auxiliary flange 82 are all made of electrically insulative material and increase the creepage distance above the secondary winding 40 between the core 30 and the secondary winding 40. Likewise, the bottom shroud 78, including the laterally extending channel portion 80, are made of electrically insulative material and increase the creepage distance below the secondary winding 40 between the core 30 and the secondary winding 40.

Similarly, the bobbin 46 includes a sleeve section 90 made of electrically insulative material, around which the secondary winding 42 is wound, and a top flange 92 and bottom flange 94 between which the secondary winding 42 is wound. The sleeve section 90 receives and surrounds the other leg 37 of the U-core section 32 with insulative material to insulate the U-core 30 from the secondary winding 42. Also, the sleeve 90 has a top extension 96 made of electrically insulating material that extends above the top flange 92 to or near the upper end 38 of the U-core leg 37 and a bottom shroud 98 made of electrically insulating material that extends below the bottom flange 94 to or near the bottom of the U-core leg 37. The bottom shroud 98 also has a channel portion 100 that extends laterally along the top and sides of the yoke portion 39 of the U-core 30. The top extension 96 also has an auxiliary flange 102 extending outwardly from the top extension 96 a distance above the top flange 92. The top flange 92, top extension 96, and auxiliary flange 102 are all made of electrically insulative material and increase the creepage distance between the core 30 and the secondary winding 42 above the secondary winding 42. Likewise, the bottom shroud 98, including the laterally extending channel portion 100, are made of electrically insulative material and increase the creepage distance between the core 30 and the secondary winding 42 below the secondary winding 42. An electrically insulative sheet 112 is wrapped around the yoke portion 39 of the U-core section 32 to provide additional creepage distances.

As best seen in FIGS. 8 and 9, the bobbin 44 includes a set of pins 104, 106 at the inner end of the channel portion 80 that electrically connect the secondary winding 40 to the printed circuit board 50, and the other bobbin 46 includes a set of electrical connector pins 108, 110 at the inner end of the channel portion 100 that electrically connect the secondary winding 42 to the printed circuit board 50 by mounting in socket holes in the printed circuit board 50 when the printed circuit board 50 is assembled to the bobbins 44, 46 in the base module 14. Two of the socket holes 114, 116 in the printed circuit board, which are provided and aligned to receive the electrical connector pins 104, 108, are revealed by the cutaway of the insulation sheet 112 in FIG. 8, and the other two socket holes in the printed circuit board 50 that align with the connector pins 106, 110 are hidden by the insulation sheet 112 in FIG. 8. These connector pins 104, 106, 108, 110 facilitate a unitary assembly of the U-core section 32, two bobbins 44, 46, and printed circuit board 50 together without direct wire connections of the secondary windings 40, 42 to the printed circuit board 50, which is more robust and less susceptible to breakage from vibrations than conventional wire connections of secondary windings to electronic circuits in conventional current transformers. The pin 104, 106, 108, 110 connections to the printed circuit board 50 also provide fixed locations of the pins 104, 106, 108, 110 in relation to the windings 40, 42 and the conductive U-core section 32, which ensures fixed clearance and creepage distances, unlike conventional wire connections that are flexible enough to move around and cause safety isolation concerns unless extra measures are taken to secure the wires. Therefore, this structure avoids the time and labor that would otherwise be required in the assembly of the current transformer for such extra measures. It is also easier to solder secondary winding wires to the connector pins 104, 106, 108, 110 in the bobbins 44, 46 than to solder thin secondary winding wires to the printed circuit board 50.

The housing 60 of the base module 14 is also made in a manner to enhance safety isolation without the need for potting the interior and electrical components or sonic welding of casings in order to meet safety isolation requirements, which is an advantage for manufacturing and assembling. Such potting and sonic welding can also affect the accuracy of current transformers, so conventional current transformers that require potting and/or sonic welding have to be verified for accuracy again after the potting and/or sonic welding, which adds another manufacturing process step and has the potential of causing quality control rejections of finished devices. In contrast to such conventional current transformer manufacturing issues, the main housing section 60 of example current transformer 10 is made as a unitary, hollow, component that receives and mounts the entire, unitary assembly of the U-core section 32, bobbins 44, 46 with secondary windings 40, 42, and printed circuit board 50, which was described above, through an open bottom 118. Therefore, there are no side seams in the main housing section 60 that that have to be sonic welded in order to provide the required clearance and creepage distances.

The open bottom 118 of the main housing 60 allows access to the printed circuit board 50 for calibration after the entire current transformer 10, including the cover module 16, is assembled, except for the bottom panel 56. Once calibrated, the only remaining assembly step is to snap the bottom panel 56 into place to close the bottom opening 118 of the main housing 60, which is a simple operation that sets a pair of resilient snap dogs 113, 115, at opposite ends of the panel 56 to engage ridges, 117, 119, respectively, at the bottom of the main housing 60, which does not affect the calibration. The bottom panel 56 also has sidewalls 120, 122 that extend into the main housing 60 far enough, when the bottom panel 56 is snapped into place, to surround the printed circuit board 50 and sides of the yoke portion 39 of the U-core section 32, which provides a large creepage at the bottom of the base module 14 for safety isolation. Additional catches 123 in the center portions of the sidewalls 120, 122 of the bottom panel 56 engage mating protrusions or other catch features in the main housing 60 (not visible in the drawings, but understandable by persons skilled in the art) enhance secure attachment of the bottom panel 56 to the main housing 60.

Figure 4:
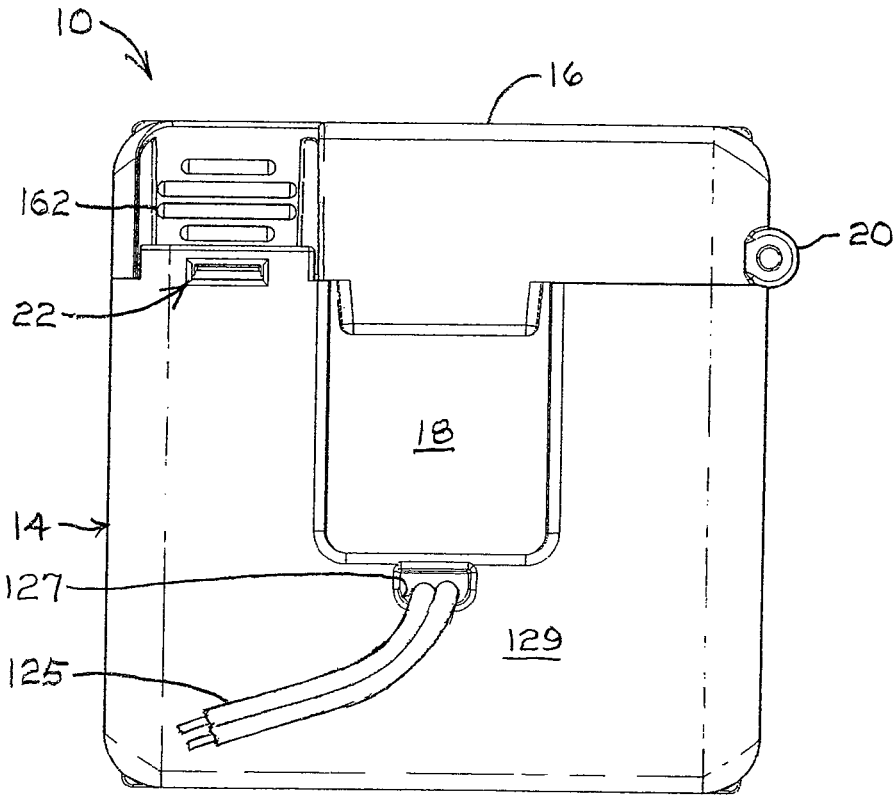
FIG. 4 is a back elevation view of the example split-core current transformer in FIG. 1.

The current measurement signals from the printed circuit board 50 are output via lead wires 125, which extend through a duct 127 in a side, e.g., the back side 129, of the main housing 60, as best seen in FIGS. 4 and 5. Therefore, any pulling or tugging on the lead wires 125 cannot dislodge or open the bottom panel 56 once it is installed as described above Also, wrapping the lead wires 125 around the top of the U-core yoke portion 39, which is between the duct 127 and the printed circuit board 50, before soldering the lead wires 125 to the printed circuit board 50 provides excellent strain relief The length of the duct 127 also provides beneficial clearance and creepage distances, which are excellent when the duct 127 extends from the back side 129 to at least the middle of the housing 60, e.g., at least half way through the interior of the housing 60.

The top walls 124, 126 of the main housing 60 also close the top of the main housing 60, except for windows 128, 130 that are sized and shaped to allow protrusion of the top ends 36, 38 of the U-core legs 135, 137 for contact with the closing-bar core section 34 in the cover module 16, as explained above. The upper ends of the extensions 76, 96 also protrude through the windows 128, 130 around the legs 135, 137 with the auxiliary flanges 82, 102 positioned just under the top walls 124, 126, which also helps to maintain a large creepage distance.

The closing-bar core section 34 is nested in the cover module 16, which comprises a cover housing 140 that is pivotally attached to the main housing 60 of the base module 14 by the hinge 20, which can be any structure or combination of components that provides a pivotal or hinged attachment. The cover housing 140 has an open top 142 and a closed bottom 144, except for windows 146, 148, which allow protrusion of the top ends 36, 38 of the U-core section 32 into the cover module 16 to contact the closing-bar core section 34 at the interfaces 31, 33 explained above. A cap panel 150 snaps into place on the cover housing 140 to close the open top 142 with a pair of springs 152, 154 mounted between the cap panel 150 and the closing-bar core section 34 to apply a bias force against the closing-bar core section 34 toward the bottom 144 of the cover housing 140. Therefore, when the cover module 16 is closed onto the base module 14, the top ends 36, 38 of the U-core section 32 protrude into the cover module 16 to contact and interface with the closing-bar core section 34. The springs 152, 154 in the cover module 16 bear on the closing-bar core section 34 in a yieldable manner to allow some adjustment of the position of the closing-bar core section 34 to accommodate the protrusion of the top ends 36, 38 of the U-core section 32 into the cover module 16 while maintaining the closing-bar core section 34 in snug contact with the contacting interfaces 31, 33 of the U-core section 32 to minimize the air gap between the closing-bar core section 34 and the U-core section 32, thereby maximizing the core 30 permeability for enhanced current transformer 10 performance.

As mentioned above, a latch mechanism 22 latches the cover module 16 to the base module 14 when the cover module 16 is closed onto the base module 14. In the example current transformer 10, the latch mechanism comprises two squeeze latches 160, 162 on opposite sides of the cover housing 140. As best seen in FIG. 6, the squeeze latch 160 is a resilient extension of the cover housing 140 and comprises a dog 164 on its distal end that engages a catch 166 in the main housing 60 to latch the cover module 16 to the base module 14 in a releasable manner. The catch 166 can be provided in any convenient manner, for example, a peripheral surface of a hole in the main housing 60 as illustrated in FIG. 6, a ledge, a shoulder, or other structure or component that can be engaged in a releasable manner by the dog 164. Likewise, the squeeze latch 162 is a resilient extension of the cover housing 140 and comprises a dog 168 on its distal end that engages a catch 170 in the main housing 60 to latch the cover module 16 in a releasable manner to the base module 14. The external surfaces of the squeeze latches 160, 162 are substantially flush with the adjacent external surfaces of the base module 14 and cover module 16. Also, the squeeze latches 160, 162 are molded in a unitary manner with the cover housing 140 so that no assembly of the latches 160, 162 to the cover housing 140 is required. The term "substantially" in this context means that this latch mechanism 22 has no parts that protrude outwardly from the body housing 60 or the cover housing 140, or from adjacent exterior surfaces of the body housing 60 or cover housing 140, enough to snag or bind with external obstacles in tight spaces such as in normal or typical electrical switch boxes, fuse boxes, or other electrical service panels where current transformers are typically installed and used, as will be understood by persons skilled in the art. Consequently, this latch mechanism 22 has a number of advantages over other state-of-the-art split-core current transformers. For example, there are no latch parts that protrude outwardly from either the body housing 60 or the cover housing 140 to snag or bind with external obstacles in tight spaces either when the cover module 16 is latched or when it is unlatched from the base module 14. Also, for example, the cover module 16 can be unlatched and opened easily, even with a user's thickly gloved hands in tight electrical panel spaces by simply grasping the latches 160, 162 on opposite sides of the cover module 16 between the user's thumb and forefinger and squeezing to unlatch and open the cover module 16 from the base module 14. Also, the latch mechanism 22 firmly and securely latches the cover module 16 to the base module 14 in a manner that will not come loose from external forces on the cover module 16, for example, when the cover module 16 is forcibly closed on the base module 14 and latched around a large conductor W that is almost too big for the aperture 18.

In contrast, some of the other state-of-the-art split-core current transformers have latches that protrude significantly from adjacent exterior surfaces. Still others protrude little, if any, when latched, but they protrude significantly when unlatched and opened. Such protruding latch components in those types of state-of-the-art split-core current transformers can be very awkward and inhibiting when trying to maneuver the open current transformer around or onto a high power conductor in a tight space, for example, in a switch box, fuse box, or other electrical service panel where there are other wires or obstacles in close proximity. Such protrusion of a latch component causes at least two serious problems: (i) It makes the current transformer more difficult to install, because it becomes bulkier and harder to feed the cover housing between two closely spaced conductors, for example, in an electrical service panel; and (ii) There is a risk of breaking off such extended or protruding latch components during installation or removal. Therefore, by integrating the latches 160, 162 into the cover housing 140 as explained above, such problems with protruding latch components are eliminated.

Some of the other state-of-the-art split-core current transformers have screw fasteners that require turning for fastening one portion of the device in closed mode to another portion, and some other state-of-the-art split-core current transformers have latches that require getting a fingernail or thin object into a slot or under a ledge to pry the latch open. Those and other maneuvers that are almost impossible to perform with gloved hands are not needed for unlatching and opening the latch mechanism 22 with the latches 160, 162 of the example current transformer 10, which can be opened by squeezing as described above.

To close, the cover module 16 can simply be pivoted about the hinge 20 (FIG. 5) to closed position until the dogs 164, 168 on the distal ends of the resilient latches 160, 162 engage and self-latch to the catches 166, 170, as shown in FIG. 6. Some other state-of-the-art split-core current transformers have covers that completely separate from the rest of the current transformer body when opened, which is conducive to dropping such covers accidentally. The hinged attachment 20 of the cover module 16 to the base module 14 as described above eliminates that problem.

Since this latch mechanism with the resilient latches 160, 162 utilizes essentially no space in the interior of the main housing and very little space in the cover module 16, as described above, it is an important packaging feature that contributes to the compactness and overall small size of the current transformer 10, even though the closing-bar core section 34 in the cover module 16 needs and occupies a large space in the cover module 16.

In another example embodiment (not shown) the latch mechanism can have only one squeeze latch similar to either of the squeeze latches 160, 162 described above, but located on the end of the cover housing 140 that is opposite the hinge 20. Such a single squeeze latch may have a resilient extension of the cover housing 140 and comprises a dog on its distal end that engages a catch in the main housing 60 to latch the cover module 16 to the base module 14 in a releasable manner in much that same configuration and manner as described above for the squeeze latch 160 with the dog 164 that engages the catch 166. Also, such a single squeeze latch can be molded in a unitary manner with the cover housing 140 so that no assembly of the latch to the cover housing 140 is required, and the resilient extension can be substantially flush with the adjacent exterior surfaces of the cover housing 140 as also described above so that no latch parts, whether latched or unlatched, protrude outwardly from the body housing 60 or the cover housing 140 enough to snag or bind with external obstacles in tight spaces.

Figure 11:
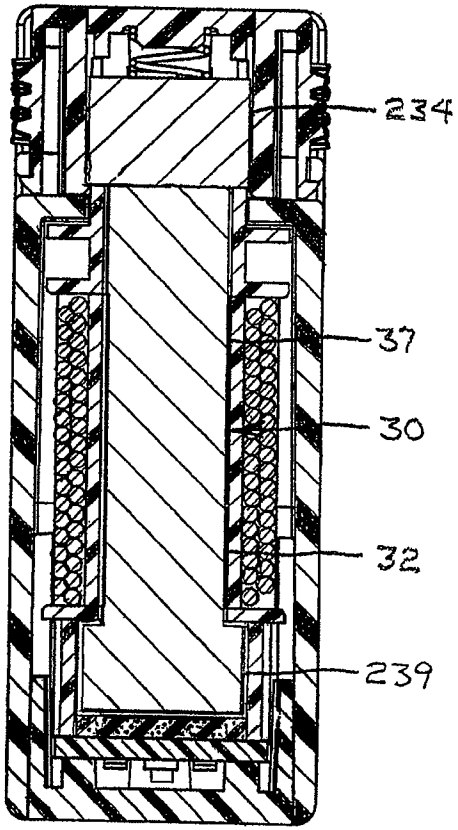
FIG. 11 is a cross-section view similar to FIG. 6 taken along section line 6-6 of FIG. 3, but illustrating the variation of the split-core components of FIG. 10.
Figure 10:
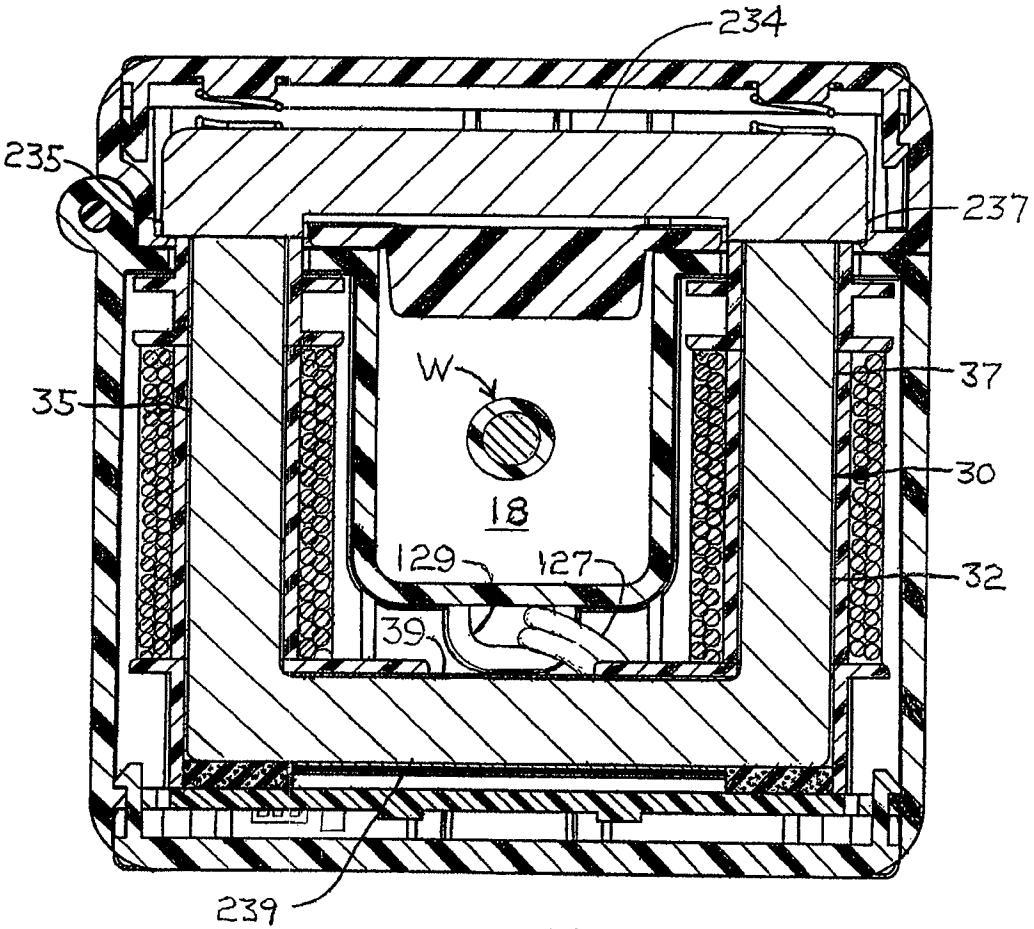
FIG. 10 is a cross-section view similar to FIG. 5 taken along section line 5-5 of FIG. 3, but illustrating a variation of the split-core components.

In the example current transformer 10 shown in FIGS. 5-9, the closing-bar core section 34 is essentially in the shape of a straight bar, sometimes called an I-core section 34. Referring now to FIGS. 10 and 11, the top section of the magnetic core 30, i.e., the closing-bar core section 234 that spans and closes the open end of the U-core section 32, is shown as a shallow U-core 234 itself, instead of the straight I-core shaped closing-bar core section 34 in FIGS. 5-9. The shallow U-core closing-bar core section 234 has leg portions 235, 237 that are shorter than the leg portions 35, 37 of the U-core section 32. For example, to maintain compactness of the current transformer while providing sufficient length of the U-core section 32 leg portions 35, 37 to accommodate effective secondary windings 40, 42, and smooth operation of the cover module 16 to open and close, including to provide an effective contacting interface of the shallow U-core section 234 with the U-core section 32, the leg portions 235, 237 of the shallow U-core section 234 are any length that is between zero percent and ten percent of the length of the leg portions 35, 37 of the U-core section 32. Also, as best seen in FIG. 11, the yoke portion 239 could be wider or have a larger cross-section than the U-core legs 35, 37, if desired, to further reduce magnetic reluctance of the core 30 and to reduce susceptibility of the core 30 to magnetic saturation. One or both of these alternatives can be used in combination with, or instead of, features or structures described above and shown in FIGS. 1-9.

The over-sizing of the closing-bar core section 234 is easily accomplished when using ferrite magnetic material for the deep U-core section 32 and the shallow U-core section 234, because ferrite can be molded and sintered in just about any shape and size core sections desired. The over-size ratios described above for the I-core section 34 are applicable for the shallow U-core section 234.

A shallow U-core section 234 for the closing-bar core section similar to that shown in FIGS. 10 and 11, but without the over-sizing of the shallow U-core closing-bar core section 234 described above, is also useful for implementations in which the magnetic core 30 is made of a tape-wound nickel-iron, silicon-iron, or other magnetic material that is available in tape form. Such magnetic tape material can be wound around a mandrel in a square, rectangular, or other shape of a desired size, fused into a solid magnetic core, and then cut into two pieces to form the split-core 30—one piece being of a deep U-shape for the U-core section 32 and the other piece being of a shallow U-shape for the shallow U-core closing-bar core section 234. In that configuration, the shallow U-core closing-bar core section 234 would not be over-sized as compared to the deep U-core section 32, but the somewhat higher magnetic permeability and less brittle, higher durability of such tape-wound core materials might be a desirable trade-off for some applications. Also, some further processing to widen the shallow U-core section 234 can be done, although it would be an additional manufacturing cost.

The foregoing description is considered as illustrative of the principles of the invention. Furthermore, since numerous modifications and changes will readily occur to those skilled in the art, it is not desired to limit the invention to the exact construction and process shown and described above. Accordingly, resort may be made to all suitable modifications and equivalents that fall within the scope of the invention. The words "comprise," "comprises," "comprising," "include," "including," and "includes" when used in this specification are intended to specify the presence of stated features, integers, components, or steps, but they do not preclude the presence or addition of one or more other features, integers, components, steps, or groups thereof. Also, directional references used herein, such as top, bottom, above, and below, are for convenience in describing relationships of components and parts as they appear in the drawings, but are not intended to imply that the current transformer 10 or any variation has to be used in the orientation shown in the drawings or that those features, parts, or components have to be in those orientations in real use. On the contrary, the current transformer 10 and alternatives can be, and are often, used in different orientations, including right side up, upside down, and other orientations.

The embodiments of the invention in which an exclusive property or privilege is claimed are defined as follows:

1. Split-core current transformer apparatus, comprising:

a U-core section with two leg portions that are connected by a yoke portion such that the two leg portions are spaced apart from each other, said U-core section being nested in a base module with the ends of the leg portions are exposed outside of the base module;

a closing-bar core section housed in a cover module that is connected pivotally to the base module in a manner that places the closing-bar core section in contact with both of the leg portion ends of the U-core section when the cover module is pivoted to a closed position in relation to the base module and that separates the closing-bar core section from the leg portions of the U-core section when the cover module is pivoted to an open position in relation to the base module;

a secondary winding around at least a portion of the U-core section; and a latch mechanism that latches the cover module to the base module in the closed position, said latch mechanism including latch components in the cover module that are releasable from mating latch mechanism components in the base module by squeezing forces directed inwardly on opposite sides of the cover module, wherein none of the latch components in either the cover module or the base module protrude substantially outward from adjacent exterior surfaces of the cover module and base module in either latched or unlatched mode.

2. Split-core current transformer apparatus, comprising:

a U-core section with two leg portions that are connected by a yoke portion such that the two leg portions are spaced apart from each other and each of the two leg portions has an interface end surface a spaced distance apart from an interface surface of the other leg portion, and wherein the U-core section is nested in a base module with the interface surfaces of the leg portion ends exposed outside of the base module;

a closing-bar core section housed in a cover module in a manner that places the closing-bar section in contact with both of the interface surfaces of the leg portion ends of the U-core section when the cover module is in a closed position in relation to the base module and that separates the closing-bar core section from the interface surface areas of the leg portion ends when the cover module is in an open position in relation to the base module; and a latch mechanism that latches the cover module to the base module in the closed position, said latch mechanism including latch components in the cover module being releasable from mating latch mechanism components in the base module by squeezing forces directed inwardly on opposite sides of the cover module, wherein none of the latch components in either the cover module or the base module protrude substantially outward from adjacent exterior surfaces of the cover module and base module in either opened or closed position of the cover module.

3. The current transformer apparatus of claim 2, wherein the latch components in the cover module and the latch components in the base module have exterior surfaces that are substantially flush with exterior surfaces of the cover module and base module in both latched and unlatched modes.

4. The current transformer apparatus of claim 2, wherein the latch components in the cover module include a first resilient extension on one side of a cover housing of the cover module, said first resilient extension comprising a first dog on a distal end of the first resilient extension that is shaped to engage a first catch in the base module to latch the cover module to the base module in a releasable manner, and a second resilient extension on an opposite side of the cover housing, said second extension comprising a second dog on a distal end of the second resilient extension that is shaped to engage a second catch in the base module to latch the cover module to the base module in a releasable manner.

5. The current transformer apparatus of claim 4, wherein the first resilient extension is flush with adjacent exterior surfaces of the cover housing, and the second resilient extension is substantially flush with adjacent exterior surfaces of the cover housing.

6. The current transformer apparatus of claim 2, wherein the latch components in the cover module include a resilient extension on a side or end of a cover housing of the cover module, said resilient extension comprising a dog on a distal end of the resilient extension that is shaped to engage a catch in the base module to latch the cover module to the base module in a releasable manner.

7. The current transformer apparatus of claim 6, wherein the resilient extension is flush with adjacent exterior surfaces of the cover housing.

8. The current transformer apparatus of claim 6, wherein the resilient extension is part of a side or end of the cover housing that is opposite a hinge connection of the cover module to the base module.

9. Current transformer apparatus for measuring AC current flow in an electric wire or bus bar, said current transformer apparatus being of a type comprising a split magnetic core, a U-core section of the split magnetic core being housed in a non-conductive base housing module and a closing bar core section of the split magnetic core being housed in a non-conductive cover module in such a manner that closing the cover module on an end of the base housing module places the closing bar core section in contact with exposed ends of the U-core section through the end of the base housing module, said U-core section being assembled together with at least one secondary coil wound on a bobbin that is mounted in surrounding relation to at least a portion of the U-core section and electric circuit components that condition and process an output of the secondary coil induced by a magnetic field in the split magnetic core into current measurement signals, said electric circuit components being further of a type that may be calibrated with the secondary coil, bobbin, and split magnetic core for accurate performance and current flow measurements prior to assembly in the base housing module but that are susceptible to degradation of such performance and measurement accuracy as a result of the assembly in the base housing module thereby necessitating recalibration after assembly for accurate performance and current flow measurements, said current transformer apparatus characterized by the electronic circuit components being mounted in a final operative position in the base housing module adjacent to an access opening in a different part of the base housing module than the end of the base housing module through which the closing bar core section contacts the U-core section and that allows access to the electronic circuit components in said final operative position after the assembly for recalibration, and a closure panel of a type that has no mechanical, electrical, or magnetic effect on any aspect of the current transformer apparatus that affects calibration and that is sized, shaped, and adapted for closing the access opening in the base housing module, whereby the electronic circuit components may be accessed and recalibrated in said final operative position for performance and measurement accuracy through the access opening in the base housing module after assembly of the secondary coil, bobbin, U-core section, and electric circuit components in the base housing module and then closed inside the base housing module with no further degradation in performance and measurement accuracy by closing the access opening in the base housing module with the closure panel.

10. The current transformer apparatus of claim 9, wherein:

(i) the U-core section has two leg portions that are connected by a yoke portion such that the two leg portions are spaced apart from each other and each of the two leg portions has an interface end surface a spaced distance apart from an interface surface of the other leg portion, and wherein the U-core section is nested in the base housing module with the interface surfaces of the leg portion ends exposed outside of the end of the base housing module, which is opposite to the access opening; and (ii) the closing-bar core section is housed in the cover module in a manner that places the closing-bar section in contact with both of the interface surfaces of the leg portion ends of the U-core section when the cover module is in a closed position in relation to the end of the base housing module and that separates the closing-bar core section from the interface surface areas of the leg portion ends when the cover module is in an open position in relation to the base module;

wherein the at least one secondary coil comprises:

(i) a first secondary winding that is wound on a first bobbin and positioned around one of the leg portions of the U-core section, said first secondary winding terminating in electrically conductive pin connectors extending from the first bobbin; and (ii) a second secondary winding that is wound on a second bobbin and positioned around the other leg portion of the U-core section, said second secondary winding terminating in electrically conductive pin connectors extending from the second bobbin; and wherein the U-core section, first and second windings and bobbins, and electronic circuit components are a unitary assembly that is mountable as a unit in the base housing module through the access opening such that the electronic circuit components are accessible through the access opening until the access opening is closed.

11. The split core current transformer apparatus of claim 10, including lead wires extending from the printed circuit board through a lateral duct in a side panel of the base module that is not either the first end of the base module or the second end of the base module to the outside of the base module for outputting the current signals from the conditioning and processing components, wherein the lateral duct extends from the side panel to at least midway in the base module housing to provide clearance and creepage distances.

12. The current transformer apparatus of claim 10, including a resilient cushioning pad positioned between the electronic circuit components and the yoke portion of the U-core section.

13. The current transformer apparatus of claim 10, wherein the base housing module, except for the access panel, is a seamless body.

* * * * *